United States Patent [19]

Goyanes

[11] Patent Number: 4,862,622

[45] Date of Patent: Sep. 5, 1989

[54] LINK TYPE CARTRIDGE SPEED LOADING DEVICE

[76] Inventor: Angel G. Goyanes, Avenida Higuerotes No. 71, Prado de Maria, Caracas, 1.040, Venezuela

[21] Appl. No.: 228,678

[22] Filed: Aug. 5, 1988

[51] Int. Cl.[4] ..... F42B 39/04

[52] U.S. Cl. ..... 42/89

[58] Field of Search ..... 42/89

[56] References Cited

U.S. PATENT DOCUMENTS

| | | | |
|---|---|---|---|
| 1,137,543 | 4/1915 | Sergeeff | 42/89 |
| 1,231,106 | 6/1917 | Wesson | 42/89 |
| 1,835,517 | 12/1931 | Otto | 42/89 |
| 1,891,437 | 12/1932 | Milmore | 42/89 |
| 1,969,817 | 8/1934 | Milmore | 42/89 |
| 2,073,436 | 3/1937 | Woodhead | 42/89 |
| 4,254,571 | 3/1981 | Peter et al. | 42/89 |
| 4,614,053 | 9/1986 | Billman | 42/89 |

*Primary Examiner*—Charles T. Jordan

*Attorney, Agent, or Firm*—Lowe, Price, LeBlanc, Becker & Shur

[57] ABSTRACT

A speed-loading mechanism for securing and releasing cartridges into a multiple chamber cylinder of a firearm comprises a plurality of links pivotally connected together. The device comprises a plurality of substantially identical intermediate links and a master link and an end link establishing opposite ends of the device. Each intermediate link has first and second disk-like portions. The first disk portion of one link is juxtaposed beneath and rotatably connected to the second disk-like portion of an adjacent link. A flat coil spring sandwiched between the juxtaposed first and second disk portions biasing the link series into a circular configuration matching the revolver chamber pattern to enable simultaneous insertion of the cartridges into the cylinder chambers. In the circular configuration, each cartridge base is supported on the associated second disk portion by means of flanges defining retaining slots for the cartridge rim with a locking detent cooperating with the slots in a locking position to captivate the rim. Upon exertion of a pulling force on the master link causing a serial hyperextension and outward rotation of the individual links from the circular configuration past the state of substantial linear alignment of the links, the respective locking detents unlock the cartridge bases from the second disk portions enabling release of the cartridges into the cylinder chambers.

18 Claims, 6 Drawing Sheets

LINK TYPE CARTRIDGE SPEED LOADING DEVICE

TECHNICAL FIELD

The present invention relates generally to loading mechanisms for securing, storing and releasing rimmed or rimless cartridges into a multiple chamber firearm such as a revolver. More specifically, the invention relates to a link type cartridge speed-loading device having a plurality of links pivotally secured to each other to secure a cartridge by engaging around a partial circumference at the cartridge base, one link per cartridge, with the links spring biased together into a rolled configuration corresponding in radius to the center lines of the chambers in the revolver's cylinder for simultaneous insertion of the cartridges into their respective chambers in the rolled configuration, and wherein the links may be pulled away to rapidly release the cartridges into the chambers to speed load the firearm.

BACKGROUND ART

Speed loaders are commonly utilized by law enforcement agencies to provide a means for rapidly and simultaneously inserting a plurality of cartridges into a multiple chamber firearm such as a revolver. One commercially available speed loader is in the form of a cylindrical drum having a diameter corresponding to the diameter of the revolver's cylinder. The speed-loading drum is formed with circumferentially spaced chambers precisely corresponding in both spacing and size to the chambers in the revolver's cylinder. The cartridges are stored within the speed loader by inserting each cartridge base into a chamber of the speed-loading drum until a clicking sound is heard at which time a spring projecting into the bottom of the drum chamber captivates the cartridge rim. To release the cartridges, they are simultaneously inserted into their respective chambers in the revolver's cylinder by grasping the revolver's cylinder with one hand and moving the speed-loading drum with the other hand in juxtaposed position with the revolver's cylinder. Thereafter, a spring-releasing knob on the face of the speed loading drum facing upwardly towards the user is manually rotated to bias the springs out of the drum chambers, enabling the cartridges to release from the drum and fall into their respective chambers in the revolver's cylinder.

The above-described speed loading drum is uncomfortable to carry in either a pocket or clipped to the user's belt, primarily due to the bulkiness of the drum, i.e., corresponding in diameter to the revolver's cylinder. The speed-loading drum is also somewhat heavy, considering its size and overall volume. It is expensive to manufacture as it requires extremely fine tolerances.

It has been proposed to provide link type cartridge speed-loading devices such as disclosed in U.S. Pat. No. 4,614,053 to Billman, issued Sept. 30, 1986. This prior art loader consists of a series of links each of which is shaped and proportioned so as to secure a cartridge by clipping around a partial circumference at its base. These links are joined together to provide the proper number of cartridges for a specific firearm. Once secured in the loader, the cartridges may be stored or transported in either a flat or rolled position. When rolled, the cartridge links clip together at the open ends such that the axial center lines of the cartridges correspond in radius to the center lines of the chambers in the revolver's cylinder. Thus rolled, the cartridges may be simultaneously inserted into their respective chambers in the cylinder and the links may be pulled away to release the cartridges into the chambers, thus rapidly loading the firearm.

The loader of the '053 patent relies upon individual links made of firm elastic materials that are sized and proportioned such that the cartridges of a specific caliber will snap or clip into or out of each link. During loading, therefore, a large amount of force must be exerted to rotate adjacent links about hinge pins (disposed to define rotational axes between the adjacent links) so as to spread the elastic cartridge engaging portions away from the cartridge base to allow the cartridge to fall into the revolver's cylinder. Further, by locating the rotational axes between adjacent links, i.e., between adjacent cartridges, an undesirable lateral or radial force component tends to act upon the cartridge base as the links rotate about the offset axes; this lateral component of force can inadvertently cause the cartridge base to 'pop out' from its chamber in the revolver's cylinder, defeating the basic function of the loader. Of course, by locating the rotational axes between adjacent links, additional parts in the form of hinge pins are disadvantageously necessary to manufacture the speed loader.

Another disadvantage of the above-identified device is the inability of the device to automatically assume a rolled configuration that would enable the cartridges projecting from the device to be easily matched and quickly inserted into the chambers of the revolver's cylinder. Although another rapid speed loader as disclosed in U.S. Pat. No. 1,891,437 to Milmore utilizes a plurality of springs to bias a series of articulated cartridge holders into a rolled configuration, these springs are mounted in a vulnerable or exposed position to the links and are therefore easily susceptible to damage that would render the loader inoperable.

DISCLOSURE OF THE INVENTION

It is accordingly one object of the present invention to provide a link type cartridge speed-loading device having a plurality of links with a unique configuration such that each link holds one cartridge by clipping to the cartridge base at the rim or rear of the cartridge and which loader can be carried or stored in a flat configuration or rolled into a circular configuration with the cartridges parallel.

Another object of the invention is to provide a loader wherein the links are capable of automatically and reliably pivoting into the rolled or circular configuration to enable rapid simultaneous insertion of the cartridges into the open chambers of the firearm.

Still another object is to provide a speed loader having a link arrangement wherein the pulling motion required to strip the loader away from the cartridges, allowing all the cartridges to fall into the chambers of the firearm, can be accomplished in a quick, reliable and full visible manner with a smooth pulling force achieved in part by locating the rotational axis of each link substantially coincident with the cartridge axis.

A further object is to provide a speed-loading device that is easy to manufacture from, for example, die-cut and stamped sheet metal.

A speed-loading device for use on revolver type firearms, in accordance with the present invention, comprises an articulated series of links equal in number to the number of chambers in a specific revolver cylinder. Each link has open sides shaped and sized to retain cartridges by extending around a partial circumference of the cartridge base to axially stabilize the cartridge retained on the link. The links are spring biased into a rolled or circular configuration substantially matching the revolver chamber pattern for the simultaneous insertion of the cartridges into the chamber cylinders and subsequent release into the chambers through a tangential pull on the first link of the series causing a serial hyperextension and outward rotation of the individual links to release their corresponding cartridges. In the rolled configuration or in a serial hyperextended state wherein the links are substantially linearly aligned with each other, locking detents provided on each link serve to retain the cartridge base in locked engagement with the link. By rotating the links slightly past the hyperextension point of linear alignment, the locking detents travel a sufficient distance so as to open the sides of the link and enable the cartridge to be released therefrom by smooth sliding movement.

In the hyperextension state of substantial linear alignment wherein the link system of the invention is unrolled into a linear state but with the cartridge base regions remaining locked to the links by the locking detents, the speed loader may be stored in a substantially flat state within an appropriate holder that may be secured to the user's belt. The link system is removed from the holder by pulling upon a handle formed with the first or master link; upon releasing from the holder, the links are automatically spring biased into the rolled configuration. Thereupon, the cartridges are simultaneously inserted into their respective cylinder chambers and, by pulling upon the handle, the pulling force acting through the first link causes the serial hyperextension and outward rotation of the individual links to occur past the linear state of hyperextension so as to cause sufficient rotation of the locking detents to release their corresponding cartridges from the links.

In accordance with a preferred feature of the invention, the speed-loading device is primarily a series of articulated intermediate links each having first and second adjacent disk portions. The first disk portion of one intermediate link is located beneath the second disk portion of an adjacent intermediate link and rotatably fixed thereto by diametrically opposed locking tabs stamped from the second disk portion interfitting within a central circular opening formed in the first disk portion of the adjacent link. The locking tabs engage the lower surface of the first disk portion and slide along the circumferential periphery of the circular opening during relative rotation of the adjacent intermediate links. The second disk portion of each intermediate link preferably includes a shaped flange projecting above the upper surface of the second disk. The flange has opposite ends circumferentially spaced from each other that may contact the cartridge shell base. Each flange end also has a circumferentially extending lower edge defining a retaining slot with the upper surface of the associated second disk portion. The cartridge rim slidably interfits within the retaining slots to prevent inadvertent dislodgement of the cartridge from the loader by axially retaining the cartridge on the second disk base.

The flange ends subtend an angular interval of less than 180° to enable the cartridge base to be seated on the second disk portion by sliding the base and rim along the upper surface until the rim engages the retaining slots with the cartridge shell contacting the flange ends or lugs. Thusly seated, the cartridge base having a rim diameter approximately equal to the diameter of the second disk portion is locked against the upper surface of the first disk portion by means of a detent formed on the first disk portion of the adjacent link juxtaposed beneath the second disk portion. As a result of relative rotation of the juxtaposed first and second disk portions of the adjacent links, the detent is movable along the circumferential periphery of the second disk portion located opposite the flange from an unlocked position in abutting contact with one of the flange ends to a locking position adjacent the other flange end and spaced therefrom by a stop projection extending from the second disk portion.

The first and second juxtaposed disk portions of adjacent links are normally spring biased into the locking position by means of a flat coil spring protectively sandwiched between the juxtaposed disk portions. The coil spring wraps around a hub portion defined by portions of the locking tabs extending towards the circular opening in the first disk portion. The springs thereby respectively define rotational axes respectively coincident with the longitudinal axis of each cartridge. In this manner, during speed loading, the tangential force applied to hyperextend the series of links advantageously acts along the longitudinal axis of each cartridge to obtain a smooth release of the cartridge from the second disk portion by hyperextension of the links beyond the substantially linear state.

In the preferred embodiment of this invention, the cartridge bases are axially retained against the link second disk portions by the retaining slots and locking detents. Close tolerances are therefore not critical as it is only necessary for the slots and detent to captivate the cartridge base rim and not exert a clamping force.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
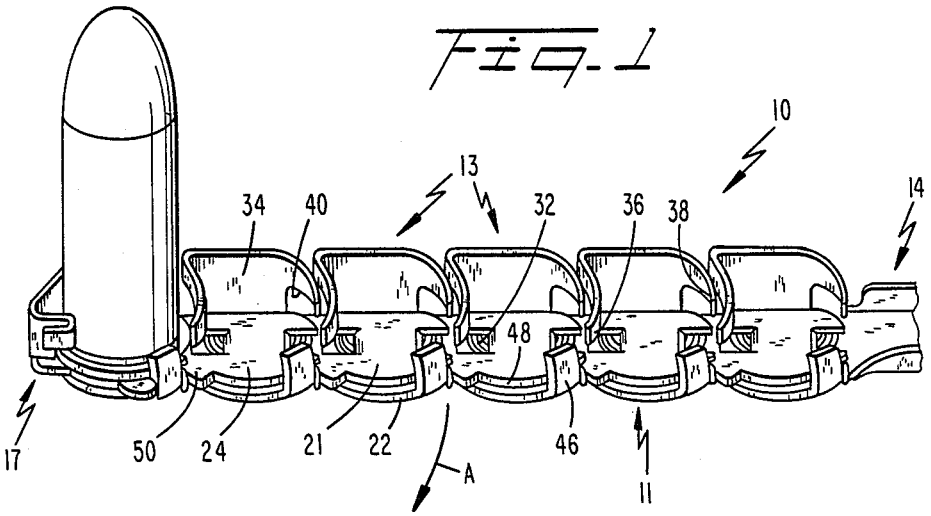
FIG. 1 is a perspective view of a speed-loading device according to my invention.
Figure 9:
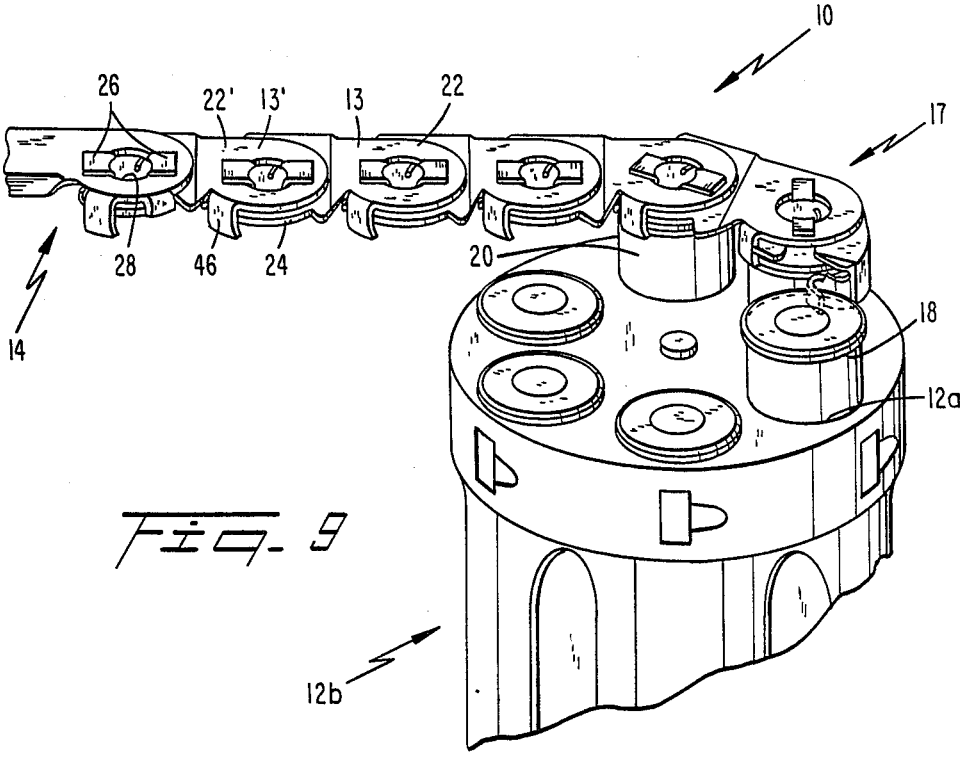
FIG. 9 is a perspective view showing the loader partially stripped away from the cartridges as they are being loaded into a typical revolver cylinder.

Referring to the drawing figures, speed-loading device 10 of the present invention and in a preferred embodiment thereof comprises a series 11 of links pivotally connected together in the unique manner set forth below and being equal in number to the number of chambers 12*a* in a specific revolver cylinder 12*b* of a revolver firearm as depicted in FIG. 9. More specifically, the device 10 comprises a plurality of intermediate links 13 pivotally connected together end-to-end in an extended line with a first or master link 14 having a finger gripping loop 15 at one end of the series with an end link 17 defining the opposite end of the series 11.

Figure 8:
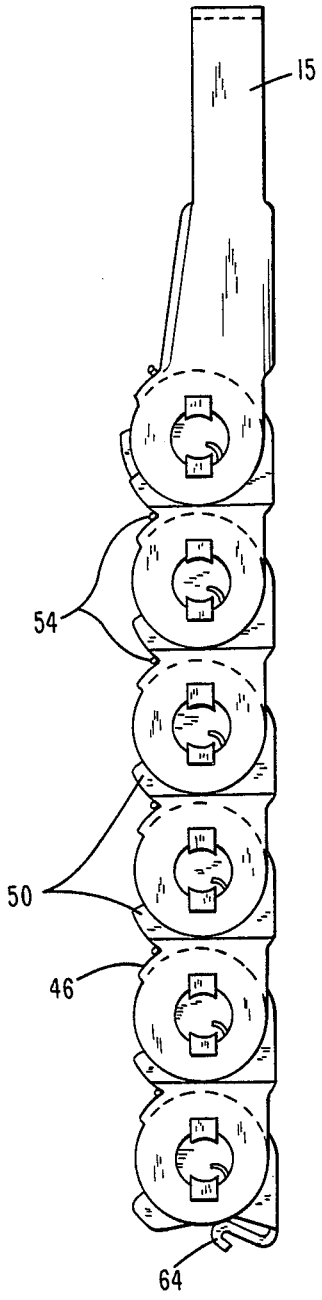
FIG. 8 is a bottom plan view of the speed-loading device depicting the link series in the hyperextension state of substantial linear alignment.
Figure 8A:
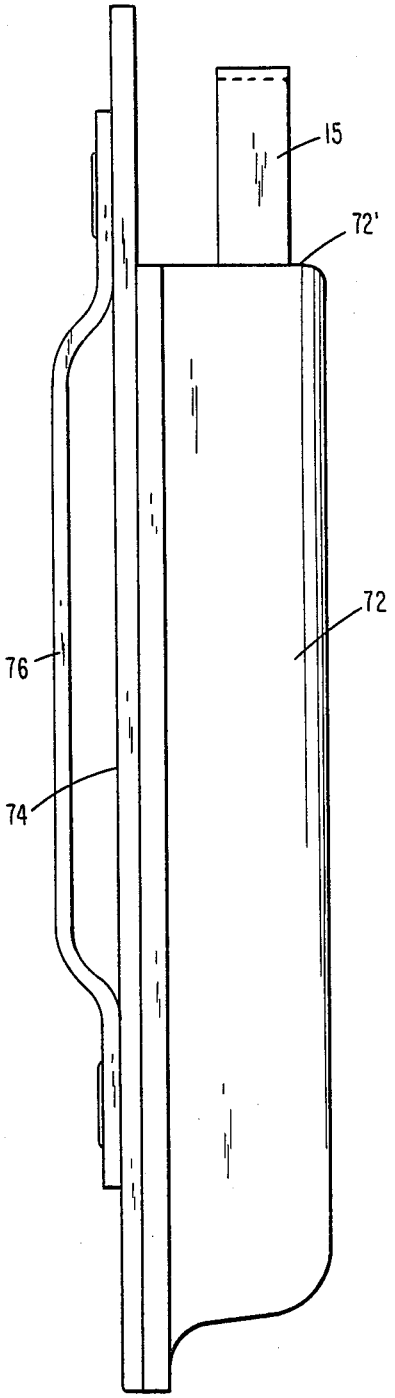
FIG. 8A is a side plan view of a holder, securable to a belt, for holding the speed loader in a generally flat configuration.

As will be seen more fully below, each link 13, 14 and 17 is formed with locking means for captivating a cartridge shell base region 18 of a cartridge 20 when the link series 11 is normally spring biased into a circular configuration (FIGS. 1, 3, 4 and 9) with the thusly secured cartridges constituting an assembly of parallel cartridges matching the revolver chamber pattern for the simultaneous insertion of the cartridges into the cylinder chambers 12*a*. The cartridges 20 are sequentially unlocked and released from their respective links 13, 14 and 17 to drop into the associated cylinder chamber through a radial/tangential pull on the finger gripping loop 15 of master link 14 (FIG. 9). This pull causes a serial hyperextension and outward rotation of master link 14 and thereafter the intermediate links 13 so that the individual links release their corresponding cartridges 20. Unlocking of the cartridge shell base 18 from its associated link 13, 14 and 17 occurs in a direction of relative movement (between the cartridge base and mounting surface 21 of the links) which is both substantially parallel and coplanar (arrow A) with the mounting surface as will be seen more fully below. Unlocking of the cartridge base 18 from its associated link 13, 14 and 17 can only occur when the locking means discussed below moves a sufficient distance to enable the cartridge base to slide off the mounting surface 21 in the aforesaid parallel direction. The degree of rotational movement necessary to enable unlocking to occur is a degree of sufficient pivotal movement of adjacent connected links achieved by serial hyperextension of the individual links beyond the point of linear alignment of FIG. 8 as discussed infra.

Each intermediate link 13 includes first and second disk portions 22 and 24, respectively, formed adjacent each other (and preferably of integral unitary construction) with the first disk portion 22 of one intermediate link 13 rotatably connected to and juxtaposed beneath the second disk portion 24 of an adjacent intermediate link 13, It will be understood that the mounting surfaces 21 constitute the upper surface of each second disk portion 24. The mounting surface 21 in the preferred embodiment is that surface in each link 13, 14 and 17 against which the cartridge shell base 18 is disposed.

In a preferred embodiment, each intermediate link 13 and the first and second disk portions 22,24 thereof are advantageously formed from sheet metal or rolled steel that is die cut and stamped to form the disk portions. Thus, in the preferred embodiment, the second disk portion 24 includes a pair of locking tabs 26 extending downwardly through a central circular opening 28 formed in the first disk portion 22 of the adjacent link 13'. The locking tabs 26 have ends 26*a* bent outwardly to engage the lower surface 29 of the juxtaposed lower first disk portion 22 with intermediate portions of the locking tabs extending towards the circular opening 28 defining a hub 30 around which a flat, coil spring 32 is disposed to bias the links 13, 14 and 17 into the rolled configuration as discussed infra.

In addition to the locking tabs 26, the second disk portion 24 of each link 13 (and end link 17) also includes a shaped flange 34 projecting above the upper or mounting surface 21 of the second disk portion. The flange 34 has opposite ends 36 and 38 circumferentially spaced from each other to contact the cartridge shell base 18. Each flange end 36 and 38 also has a circumferentially extending lower edge 40 defining a retaining or captivating slot 42 with the peripheral edge of the upper surface 21 of the associated second disk portion 24. The cartridge rim 18' of cartridge base 18 slidably interfits within the retaining slots 42 that axially retain the cartridge 20 to the mounting surface 21 to prevent inadvertent dislodgement of the cartridge from the loader 10.

Figure 6:
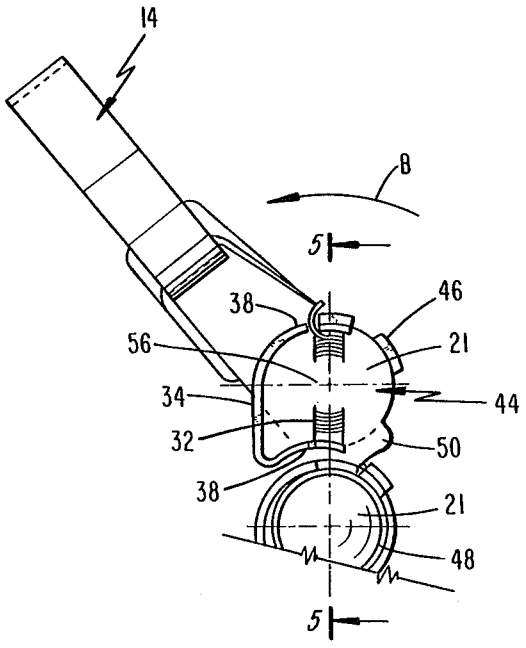
FIG. 6 is a partial top plan view of a first or master link of the device.
Figure 5:
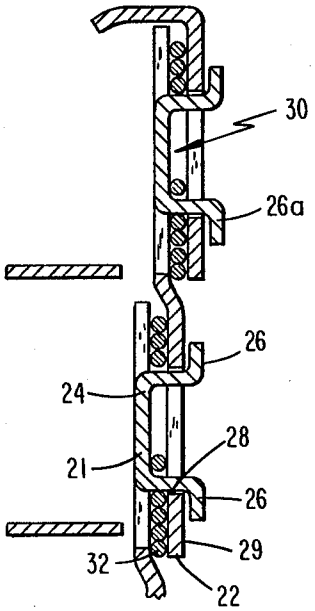
FIG. 5 is a sectional view taken along the line 5—5 of FIG. 6.
Figure 7:
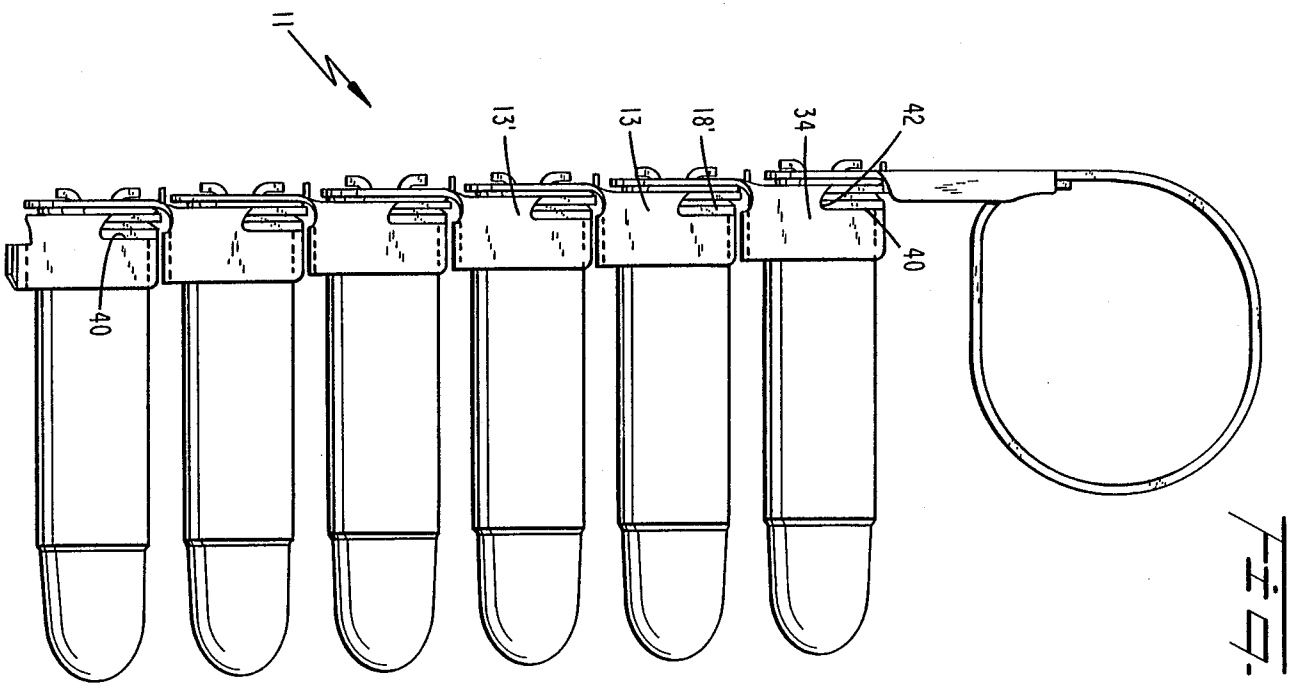
FIG. 7 is a rear elevational view of the speed-loading device.

In plan view (e.g., FIG. 6), the flange ends 36 and 38 subtend an angular interval of less than 180° to define an opening 44 therebetween enabling the cartridge base to be seated on the surface 21 of second disk portion 24 by sliding the cartridge base 18 and rim 18' along the surface 21 through the opening 44 until the rim 18' engages the retaining slots 42 with the cartridge shell contacting the flange ends or lugs 36,38. Thusly fully seated, the cartridge base 18 having a rim diameter approximately equal to the diameter of the second disk portion 24 is axially retained against the mounting surface 21 by the retaining slots 42 and locked against the upper surface of the second disk portion by means of a locking detent 46 formed on the first disk portion 22, of the adjacent link 13' (or master link 14) juxtaposed beneath the second disk portion 24. The locking detent 46 projects upwardly above and protrudes inwardly over the mounting surface 21 to extend over and captivate the cartridge rim 18' in the locking position.

As a result of relative rotation of the juxtaposed first and second disk portions 22,24, the locking detent 46 is movable along the circumferential periphery 48 of the second disk portion 24 between the flange ends or lugs 36,38. In the locked position, the detent is in abutting contact with a stop projection extending radially from the second disk portion 22; in this locked position, the detent is spring biased into abutting contact with the stop projection 50 and the location of the stop projection is what limits the relative rotation of adjacent links to obtain the rolled configuration of the link series 11.

Movement of the locking detent 46 away from the stop projection 50 (of an adjacent link) into the unlocking position during serial hyperextension of the device 10 occurs substantially when the locking detent 46 abuts against the flange end 38 located remote from the stop projection 50. In this unlocked position, the effective opening or gate width 44 (the straight line distance measured between the flange end 36 and locking detent 46) is greater than the diameter of the cartridge base 18 to enable the cartridge 20 to release from the link by sliding in the direction A away from the retaining slots 42 towards the opening 44 parallel to the mounting surface 21.

As mentioned above, the first and second juxtaposed disk portions 22,24 of adjacent links 13,13 are normally spring biased into the locking position by means of the flat coil spring 32 protectively sandwiched between the juxtaposed disk portions. One end 52 (FIG. 4) of the coil spring 32 is wrapped around the hub 30 defined by portions of the locking tabs 26 extending towards the circular opening 28 in the first disk portion 22 as mentioned supra. The other end 54 (FIG. 8) of the coil spring 32 is anchored between the locking detent 46 and the stop projection 50 respectively formed on the first and second disk portions of a common link 13. Each coil spring 32 thereby defines a rotational axis 56 respectively coincident with the longitudinal axis 58 of each cartridge 20. In this manner, during speed loading, the tangential/radial force B applied to hyperextend the series of links tends to act along the longitudinal axis 58 of the cartridge 20 to obtain a smooth release of the cartridge from the second disk portion 24 by hyperextension of the links beyond the substantially linear state.

As mentioned above, the master link 14 formed with finger gripping loop 15 defines the leading end of the link series 11 and the cartridge 20 stored on the master link is the first cartridge unlocked from the link series 11. The master link 14 comprises finger gripping loop 15 which in the preferred embodiment is integrally formed with a first disk portion 22' that is substantially identical to the first disk portions 22 of intermediate links 13. However, the first disk portion 22' of master link 14 further includes a spacer projection 60 (FIG. 2) circumferentially spaced from the locking detent 46 to contact the stop projection 50 formed on the second disk portion 24 of the intermediate link 13 connected to the master link 14 in juxtaposed relation to the first disk portion 22' of the master link. It is this spacer projection 60 that orients the handle of the finger gripping loop 15 so that it is in the tangential position of FIG. 4 with the master link 14 formed adjacent the end link 17 to complete the circular configuration of the link series 11. The spacer projection 60 thus moves circumferentially along the peripheral edge 48 of the second disk portion 24 of adjacent intermediate link 13 without projecting above the plane of the mounting surface 21 of the second disk portion to thereby avoid interference with unlocking movement of the cartridge from the master link.

Figure 3:
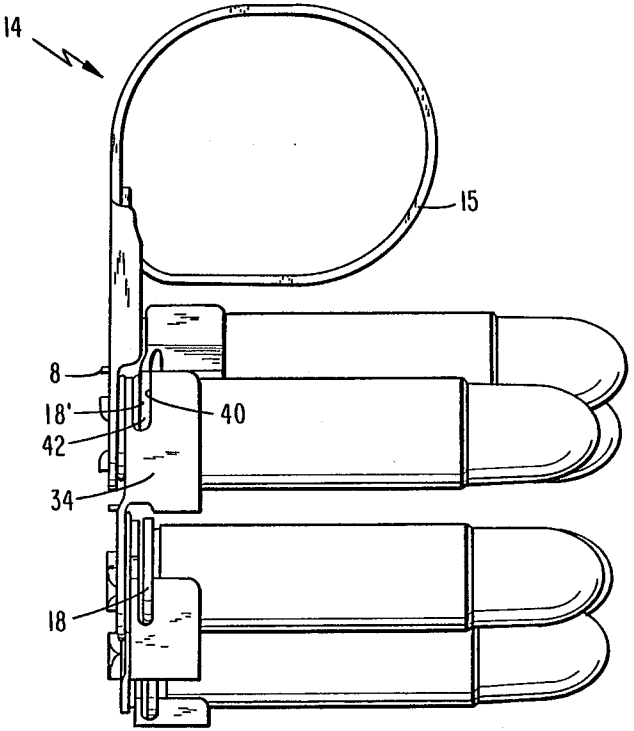
FIG. 3 is a rear elevational view of my speed-loading device in the rolled configuration.

The end link 17 defining the opposite end of series 11 essentially comprises a second disk portion 24' substantially identical to the second disk portions 24 of intermediate links 13 and a shaped flange end (defining the outermost end of the link series 11) in the form of a spur 64 adapted to contact the outer surface of the cartridge base region 18 of the cartridge captivated by the master link 14 as depicted in FIG. 3. The spur 64 of end link 17 engaging the cartridge base region of the first cartridge in master link 14 enables the first cartridge to provide the pivot point essential for the removal of the end link 17 from the last cartridge being loaded into the revolver cylinder **12*b*. Without this pivot, the last cartridge would simply rotate with the end link 17 still in place, thus preventing the removal of the loader 10**.

Figure 2:
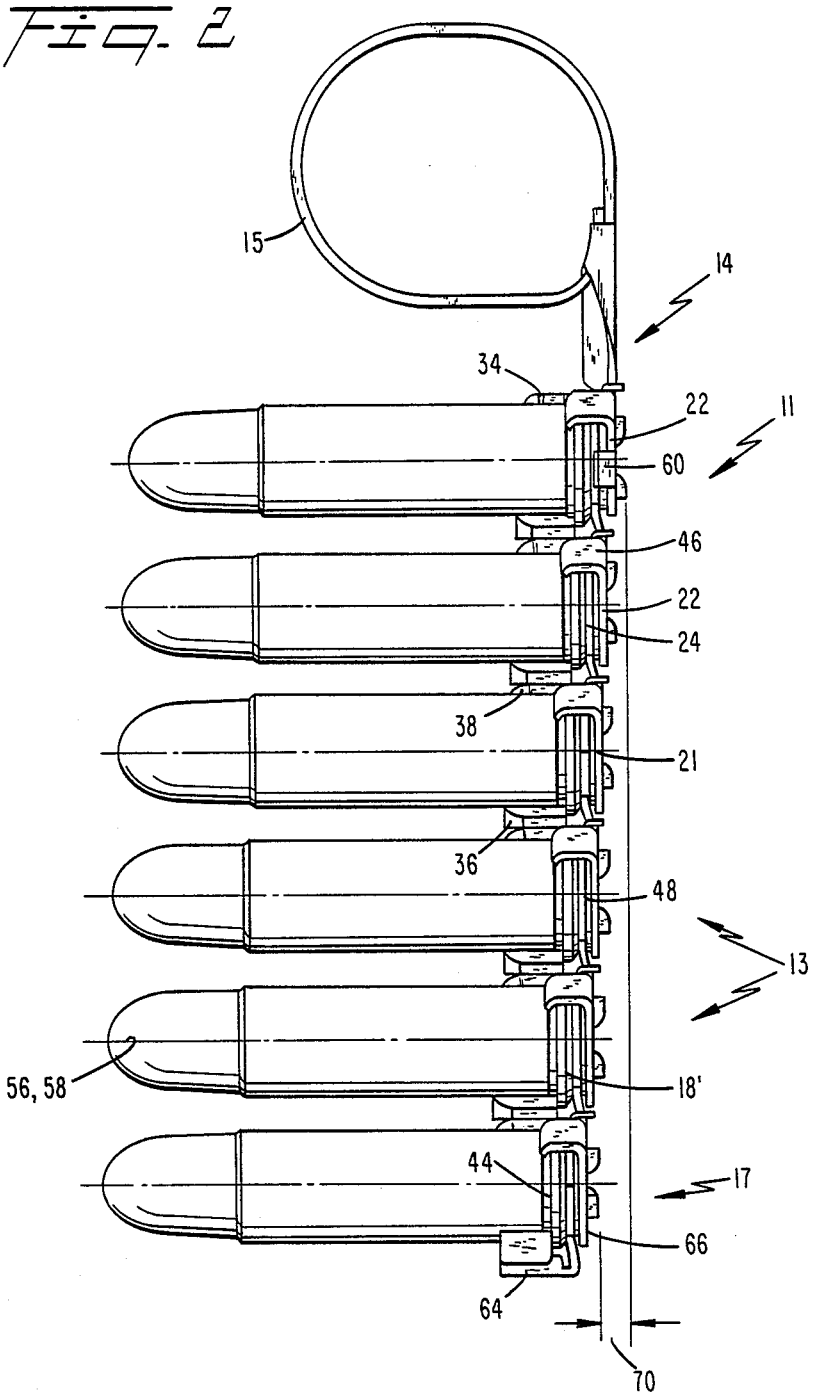
FIG. 2 is a front side plan view depicting the link series in a hyperextension state of substantial linear alignment with each other with the cartridge base regions locked within their respective links.
Figure 4:
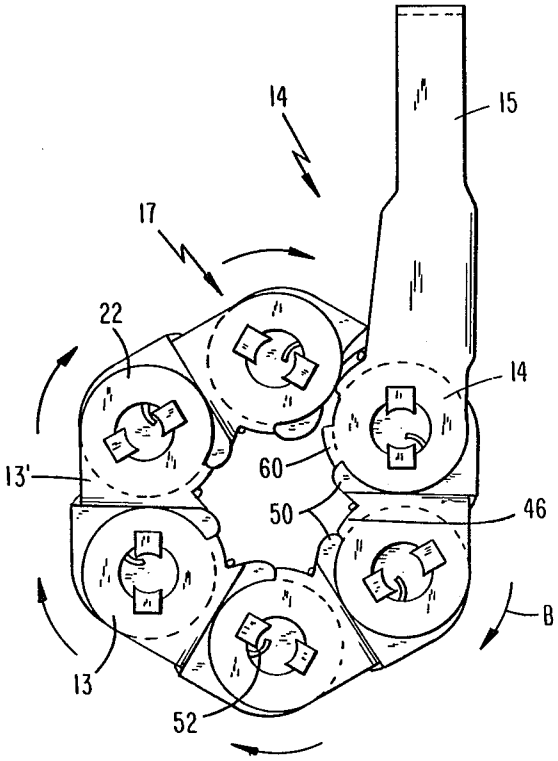
FIG. 4 is a bottom plan view of the device of FIG. 3.

As depicted in FIGS. 2 and 3, the external spur 64 on the end link 17 is spaced from the cartridge rim 18' of the first cartridge on the master link 14 by configuring the links 13, 14 and 17 so as to obtain an elevational displacement 70 between the bottom 66 on the first disk portion 22 juxtaposed beneath end link 17 and the bottom of the first disk portion of the master link 14 as depicted in FIG. 2.

Prior to speed loading, the rolled assembly may be inserted into a substantially flat holder 72 in which the link series 11 is maintained in substantial linear alignment within the holder. Thus, it will be appreciated that the thickness of the holder is substantially equal to the cartridge diameter (i.e., disk portions 22 or 24) and in this linear state it will be appreciated that the locking detents 46 of each link maintain the cartridges 20 in the locked position. A rear surface 74 of the holder 72 may be formed with a belt loop 76.

For speed loading, the finger gripping loop 15 projecting upwardly from the holder cavity 72' is grasped by the user to remove the speed loading device 10 with the cartridges 20 locked thereon. The springs 32 automatically bias the link series 13, 14 and 17 into the rolled configuration. The rolled assembly of cartridges 20 may be inserted into the chamber end **12*a* of an open firearm cylinder 12*b*, projectile end first. For speed loading, a tangential manual force B is then exerted upon the finger gripping loop 15 that causes relative rotation of the first disk portion 22 of the master link 14 in which the locking detent 46 thereof moves circumferentially along the periphery 48 of the juxtaposed second disk portion 24 of the adjacent intermediate link 13 until it contacts the flange end 38 of the second disk portion to simultaneously release the first cartridge from the master link, which cartridge is manually forced outward in a radial motion (direction A). At this point, the rim 18' of the first cartridge is held up by the external spur 64 of the end link 17. The speed loading motion is continued by pulling the master 14 link via its finger gripping loop 15 more or less tangentially releasing the cartridges in sequence until the loader is pulled free allowing all of the cartridges to fall into their respective chamber to complete the loading sequence. This process is detailed in FIG. 9 of the drawing about halfway through the sequence. As mentioned above, an important function of the end link 17 and the external spur 64** thereon is that the first cartridge released is prevented from falling completely into its respective chamber by the external spur of the end link until the last cartridge is released from the end link.

The feature of biasing adjacent links with planar spiral springs 32 arranged about each rotational axis 56 permits the juxtaposition of first and second adjacent link portions whereby the springs are protected from damage by exterior forces. The link series 11 also lends itself for use with a different number of cartridges by the interpositioning of additional intermediate links within the link series.

An important feature of the invention relates to the manner in which the links hold the cartridges by means of the captivating slots and locking detent discussed supra. In other words, the locking structure does not rely upon any tight-fitting or locking pressure requiring precise machining tolerances of locking parts and, in fact, each cartridge may be loosely held in the locking position so long as it is captivated by the slots and locking detent. This feature of course minimizes any marring or scuffing of the cartridge and also allows the cartridge to be smoothly and reliably released from the base during link hyperextension.

Another important feature of the invention is in the manner in which the pivotal or rotational axis of each link coincides with the longitudinal axis of the cartridge and the associated planar spiral spring that exerts spring pressure through the pivotal axis to maintain the cartridges locked within the associated link. In other words, it is the same spring pressure that is overcome during pivotal movement of the links into the unlocking positions that enables unlocking of each cartridge to occur by application of unlocking force along the cartridge axis; the cartridges therefore drop into their cylinder chambers as the unlocking forces act along the cartridge axis.

The stop projections, locking detents and flange ends are all suitably configured so that unlocking of a cartridge from its associated link second disk portion occurs substantially when the locking detent contacts the flange end; the flange end thus acts as a pivot point enabling the locking detent of the next-in-line link to commence rotation towards its unlocking position.

The design of the preferred embodiment also lends itself to manufacturing of the individual links utilizing sheet metal and relatively inexpensive punching or stamping techniques.

Although the present invention has been described and illustrated in detail, it is clearly understood that the same is by way of illustration and exemplary only and is not intended to be taken as limitative, the spirit and scope of the present invention being limited only by the terms of the appended claims therein.

I claim:

1. A device for speed-loading revolver type firearms, said device comprising a series of links pivotally connected together and being equal in number to the number of chambers in a specific revolver cylinder; said links each having a base and side wall means extending upwardly from the base for supporting the cartridge thereon, said side wall means having an opening and including first means for captivating a cartridge base region of the cartridge to prevent said cartridge from being removed from the base in a direction substantially perpendicular thereto and further including locking detent means movable along a circumference of the base within the opening for preventing unloading movement of the cartridge base through the opening in a first positional relationship of a pair of adjacent links, and said detent means being movable to enable said unloading movement through said opening in a second positional relationship of said pair of links, said device when loaded with cartridges comprising an assembly of parallel cartridges capable of being rolled into a circular configuration matching the revolver chamber pattern for the simultaneous insertion of the cartridges into the cylinder chambers and subsequent release into said chambers through a radial/tangential pull on a first link of the series, said pull causing a serial hyperextension and outward rotation of the individual links into said second positional relationship to release their corresponding cartridges.

2. The device of claim 1 further including spring means for biasing the links into said circular configuration in which the blocking detent means of the respective links are in the first positional relationships.

3. The device of claim 2, wherein said links are pivotable along an axis of rotation extending through the base of each link coincident with a longitudinal a axis of the cartridge supported on the base.

4. The device of claim 3, wherein said spring means includes a plurality of coil springs.

5. The device of claim 4, wherein said links are formed with first and second adjacent disk portions with the first portion of one link being location beneath the second portion of an adjacent link and means for rotatably fixing said juxtaposed first and second portions of the respective adjacent links together.

6. The device of claim 5, wherein the coil springs are respectively disposed between the first and second juxtaposed link portions.

7. The device of claim 6, wherein said first link is a master link formed with a finger gripping portion at one end thereof and with a first disk portion at the opposite end.

8. The device of claim 7, wherein said last link defining the end of said device opposite the end defined by the master link consists of a second disk portion.

9. The device of claim 8, wherein the second disk portion of the last link is formed with a spur, and wherein said links are pivotally connected together such that the first cartridge released in the loading sequence is retained above the cylinder surface by the spur of the last link and acts as a hyperextension point for the last link to effect pivotal movement between the last link and the intermediate link adjacent thereto to obtain positive release of the device from the last cartridge.

10. A device for speed-loading revolver type firearms, said device comprising a series of links pivotally connected together and being equal in number to the number of chambers in a specific revolver cylinder, substantially each said link including first and second disk-like portions with the first disk-like portion of one link juxtaposed beneath and rotatably connected to the second disk-like portion of an adjacent link, and a substantially flat spring mounted between substantially each juxtaposed first and second disk-like portions to bias the series of links into a circular configuration matching the revolver chamber pattern for the simultaneous insertion of the cartridges into the chamber cylinders.

11. The device of claim 10, wherein substantially each link includes means for locking a cartridge base region of each cartridge to the second disk-like portion when said device is in the circular configuration and when said links are in a serial hyperextension state of substantially linear alignment with each other.

12. The device of claim 11, wherein said locking means is operable to unlock the cartridge base regions from the second disk portions when respective adjacent links are rotated relative to each other to a point past the state of substantially linear alignment in a rotational direction measured from the state of circular configuration rotating towards substantial linear alignment.

13. The device of claim 12, wherein said first disk-like portion of one link is rotatably fixed to the second disk-like portion of an adjacent link by diametrically opposed locking tabs stamped from the second disk portion interfitting with a central circular opening formed in the first portion.

14. The device of claim 13, wherein said locking tabs engage the lower surface of the first disk portion and slide along the circumferential periphery of the circular opening during relative rotation of the adjacent links.

15. The device of claim 14, wherein said second disk portion includes a shaped flange projecting above an upper surface of the second disk, said flange having opposite ends circumferentially spaced from each other to contact the cartridge shell base.

16. The device of claim 15, wherein the opposite ends of each flange are formed with a circumferentially extending lower edge defining a retaining slot with the upper surface of the associated second disk portion to enable a cartridge rim of the cartridge base to slidably interfit within the retaining slots to prevent inadvertent dislodgement of the cartridge from the holder in a direction perpendicular to the upper surface.

17. The device of claim 16, wherein said opposite ends of the flange subtend an angular interval of less than about 180° to enable the cartridge base to be seated on the second disk portion by sliding the cartridge base along the upper surface until the rim engages the retaining slots with the cartridge shell contacting the flange ends.

18. The device of claim 17, wherein the first disk portion is formed with a locking detent projecting upwardly from and movable along the periphery of the first disk portion in an opening defined between the opposite ends of said flange, said detent being normally biased into a locking position preventing the cartridge from releasing from the device, and wherein said locking detent is movable into an unlocking position enabling the cartridge shell base to release from the device by movement in a direction parallel to the upper surface away from the retaining slots, movement of the locking detent into the unlocking position being caused by serial hyperextension and outward rotation of the individual links past the state of substantial linear alignment.

* * * * *